US006100855A

United States Patent [19]

Vinson et al.

[11] Patent Number: 6,100,855

[45] Date of Patent: Aug. 8, 2000

[54] GROUND PLANE FOR GPS PATCH ANTENNA

[75] Inventors: James K. Vinson; Armando DeJesus, both of Austin, Tex.

[73] Assignee: Marconi Aerospace Defence Systems, Inc., Austin, Tex.

[21] Appl. No.: 09/259,802

[22] Filed: Feb. 26, 1999

[51] Int. Cl.[7] ..... H01Q 1/48

[52] U.S. Cl. ..... 343/846; 343/700 MS; 343/845

[58] Field of Search ..... 343/700 MS, 845, 343/846, 848, 872; H01Q 1/48

[56] References Cited

U.S. PATENT DOCUMENTS

| | | | |
|---|---|---|---|
| 3,534,378 | 10/1970 | Smith | 343/828 |
| 4,658,266 | 4/1987 | Doty | 343/848 |
| 5,495,261 | 2/1996 | Baker et al. | 343/846 |
| 5,592,174 | 1/1997 | Nelson | 342/357 |
| 5,646,634 | 7/1997 | Bokhari et al. | 343/700 |
| 5,654,717 | 8/1997 | Nichols et al. | 342/357 |
| 5,694,136 | 12/1997 | Westfall | 343/700 |
| 5,706,015 | 1/1998 | Chen et al. | 343/700 |
| 5,982,335 | 11/1999 | Faraone et al. | 343/787 |
| 5,986,615 | 11/1999 | Westfall et al. | 343/846 |
| 6,002,367 | 12/1999 | Engblom et al. | 343/700 MS |

FOREIGN PATENT DOCUMENTS 880604 7/1949 Germany .

OTHER PUBLICATIONS

Braasch and Snyder, "Running interference: testing a suppression unit," *GPS World,* 50–54, 1998.

Lachapelle et al., "Marine DGPS using code and carrier in a multipath environment,"???

Tranquilla et al., "Analysis on a choke ring groundplane for multipath control in global positioning sytem (GPS) applications," *IEEE Transactions on Antennae and Propogation,* 42:905–911, 1994.

*Primary Examiner*—Don Wong
*Assistant Examiner*—Shih-Chao Chen
*Attorney, Agent, or Firm*—Fulbright & Jaworski LLP

[57] ABSTRACT

An antenna structure including a ground plane that provides a good front to back ratio while maintaing a small size and which can mechanically be made to fit into tight areas. The antenna structure may be a GPS patch antenna, or any other antenna adapted to receive broadcast signals. The ground plane is made from radar absorbing material (RAM) in electrical contract with conductive radials. The RAM inherently acts to suppress surface currents on the ground plane, which in turn reduces back signals. Although RAM has some resistance, it is low enough such that the electrical effect of the radials is extended through the RAM, essentially simulating a "solid" conductive disk. Both the RAM and radials may be made from light and flexible material, and consequently may be adapted for use in a variety of applications.

29 Claims, 4 Drawing Sheets

GROUND PLANE FOR GPS PATCH ANTENNA

BACKGROUND OF THE INVENTION

A good ground plane is beneficial for proper operation of a GPS antenna system. Without such a ground plane, severe multipath effects can disrupt the GPS signal being received by the GPS receiver. In the past, these ground planes have been large and/or bulky, making them very difficult to place inside small areas such as in portable or hand-held GPS systems.

GPS receivers receive signals directly from satellites. However, during use they also may receive indirect "multipath" signals caused by the reflection of the direct signals from large objects such as the earth. In many instances, these indirect signals are phased shifted and act to cancel out and/or distort the direct signals. Such multipath effects are undesirable because they can cause a loss of position data or a decrease in its accuracy.

Although multipath effects can occur over any surface of the earth, it is particularly troublesome over bodies of salt water. Salt water is a relatively good electrical conductor and will therefore reflect GPS signals with little attenuation. Thus, a GPS receiver trying to synchronize to a satellite signal may also receive a signal with similar information and strength from the salt water surface.

To address this and other problems, GPS patch antennas often are used in conjunction with a ground plane. A ground plane serves various functions including isolating the antenna from signals emanating from below them.

Ideally, a ground plane would be an infinite sheet of a perfect conductor. Prior art ground planes have typically employed large geometries to simulate an infinite ground plane. For example, a ground plane used by G. Lachapelle of the University of Calgary and others for the Canadian Hydrographic Service was roughly 1.5 meters in diameter. Others have implemented smaller grounds planes on the order of 50 cm's. These grounds planes are often orders of magnitude too large for use in many portable GPS systems. Another problem with prior art ground planes is that they are often attached to or buried within the ground, limiting their usefulness in portable GPS systems.

Multipath effects may also be reduced electronically through the use of suppression circuits. While they may be smaller than prior art infinite ground planes, the circuitry required to reduce multipath effects is often complex, expensive, and consumes a lot of power. Thus, electronic multipath suppression circuits are often impractical for use in many (especially portable) GPS applications.

U.S. Pat. No. 5,694,136 describes an apparatus and method for using an antenna and a physically small ground plane made from an "R-Card". The "R-Card" ground plane consists of a conductive central region surrounded by a peripheral region have a sheet resistivity that increases as radial distance from the central region increases. This configuration attempts to simulate an infinite ground plane, while remaining smaller than conventional prior art ground planes. However, the "R-Card" ground plane still has a diameter of 13 inches, which is too large for many portable GPS applications. Furthermore the "R-Card" does not suppress surface currents which will adversely affect reception of the GPS satellite data.

SUMMARY OF THE INVENTION

The present invention overcomes above-described problems with prior art ground planes. With the ground plane described in the present invention, a good front to back ratio can be achieved with an antenna system that is small and which can mechanically be made to fit in tight areas. Without it, in many compact GPS applications, one would have to use either a very inefficient ground system or a complex electronic circuit to minimize the interference.

The present invention includes an antenna structure comprising an antenna adapted to receive broadcast signals, electrically connected to a ground plane, comprising radar absorbing material (RAM) in electrical contact with at least one radial.

The antenna may be substantially centered on the ground plane. The antenna may also be placed anywhere functional on the ground plane.

The antenna may comprise a patch antenna. The broadcast signals may be GPS signals. The present invention may also be used to receive other broadcast signals such as those signals used for personal communication services, and cellular signals.

The ground plane may be substantially circular. The ground plane may also be any other functional shape.

The at least one radial may be woven through the RAM. Other methods of maintaining electrical contact between the at least one radial and the RAM may be used, such as conductive epoxy. The RAM may comprise a conductive material that is adhered to a non-conductive surface. The RAM may also be comprised of solid conductive material.

The effective length of the at least one radial may be substantially one-fourth of the wavelength of the desired broadcast signal. The effective length of the at least one radial may also be longer than one-fourth of the wavelength of the desired broadcast signal if increased performance is desired. The effective length may be slightly shorter than one-fourth of the wavelength of the desired broadcast signal if decreased performance is acceptable.

The antenna structure may further comprise a plurality of radials in electrical contact with the ground plane, the antenna, or both the ground plane and the antenna. The plurality of radials may further comprise at least four radials. More or less than four radials may also be used depending on the parameters of the application. The plurality of radials may also be spaced evenly through the radar absorbing material, or they may be spaced in an uneven manner.

In the antenna structure, the at least one radial may be comprised of high modulus material; and the ground plane may be adapted to be folded, and then assume substantially a flat configuration during use. The antenna structure may further comprise a spring that will aid in returning the ground plane to substantially its original configuration when released during use.

The antenna structure may further comprise a nonconductive layer that encases the ground plane, or the antenna, or both.

The present invention also includes a method of using an antenna structure comprising: obtaining an antenna structure, comprising an antenna, and a ground plane electrically connected to the antenna, comprising radar absorbing material and a radial in electrical contact with the radar absorbing material; and employing the antenna structure to receive broadcast signals, whereby the ground plane is adapted to improve front to back isolation of the antenna structure. The broadcast signals may be GPS signals, or they may be any other broadcast signal such as those used in personal communication systems or cellular signals.

In the method of using the antenna structure, the ground plane may improve on the front to back isolation of the antenna structure by suppressing surface currents on the ground plane during use.

In the method of using the antenna structure, the front to back signal isolation may be at least 10 dBs when measured over salt water. The front to back signal isolation may also be any minimum signal measured over a desired medium as required by the parameters of a particular application.

In the method of using the antenna structure, the effective length of the at least one radial may be one-fourth of the wavelength of a desired broadcast signal. The effective length may also be larger than one-fourth of the wavelength of the desired broadcast signal if higher performance is desired. If lower performance is acceptable, the effective length may be slightly shorter than one-fourth of the wavelength of the desired broadcast signal.

In the method of using the antenna structure, the antenna structure may further comprise a plurality of radials in electrical contact with the radar absorbing material. The plurality of radials may further comprise at least four radials. More or less radials may be used depending on the parameters of the desired application. The plurality of radials may also be spaced evenly or through the RAM. The radials may also be spaced unevenly through the RAM.

In the method of using the antenna structure, the radial or plurality of radials may be woven through the RAM to maintain electrical contact. Other methods of maintaining electrical contact between the radial or radials and the RAM may be used, such as conductive epoxy.

In the method of using the antenna structure, the ground plane may be substantially circular. The ground plane may also be in any other functional shape.

The present invention also includes a method of using an antenna structure comprising: obtaining a flexible antenna structure comprising a patch antenna, a ground plane electrically connected to the patch antenna, the ground plane comprising radar absorbing material, a plurality of radials comprising that is in electrical contact with the radar absorbing material, a spring to aid in placing the ground plane in substantially a flat configuration when released during use, and wherein the ground plane is adapted to be folded; and employing the antenna structure to receive GPS signals, whereby the ground plane is adapted to improve front to back isolation of the flexible antenna structure.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

It is to be noted, however, that the appended drawings illustrate only exemplary embodiments of the invention and are therefore not to be considered limiting of its scope, for the invention may admit to other equally effective embodiments.

DESCRIPTION OF ILLUSTRATIVE EMBODIMENTS

In a most general aspect, the invention comprises structures for improving the reception of broadcast signals while maintaining a small device size. In presently preferred embodiments, the invention is designed to minimize multipath effects and thereby increase the front to back signal ratio. While the invention may be beneficially used for other applications, such as personal communications services and cellular devices, most of the following description describes the invention in terms of an antenna structure for use in GPS applications.

For any GPS application, the greater the front to back ratio, the less time a GPS receiver needs to lock to the satellite signals. To be useful for a broad range of GPS applications, it is desirable to have a receiver that can lock to the satellite signal within a few seconds. A front to back ratio of 10 dBs was found to consistently allow the receiver to meet this goal. In contrast, a front to back ratio of 3 dBs or lower could result in a receiver that takes several minutes to lock up to the GPS satellite signals.

Furthermore, many GPS devices are portable, requiring relatively compact and sometimes flexible antenna structures.

By using a combination of radar absorbing material (RAM) and at least one radial to form a ground plane, a ground plane embodying the present invention is able to achieve good front to back isolation while maintaining a small device size. RAM inherently acts to suppress surface currents on the ground plane, which in turn reduces back signals. Although RAM has some resistance, this resistance is low enough such that electrical effect of the radials is extended through the RAM, essentially simulating a "solid" conductive disk. By itself, this effect improves on the front to back isolation of the antenna system. When taken in conjunction with RAM's ability to suppress surface currents, the present invention is able to achieve a much higher degree of isolation of the attached antenna from the detrimental effects of back signals and their corresponding electrical fields. Furthermore, unlike the heavier, inflexible materials used in prior art ground planes, the RAM used in the present invention is light and flexible, and consequently may be adapted for use in a variety of applications as described below.

Figure 1:
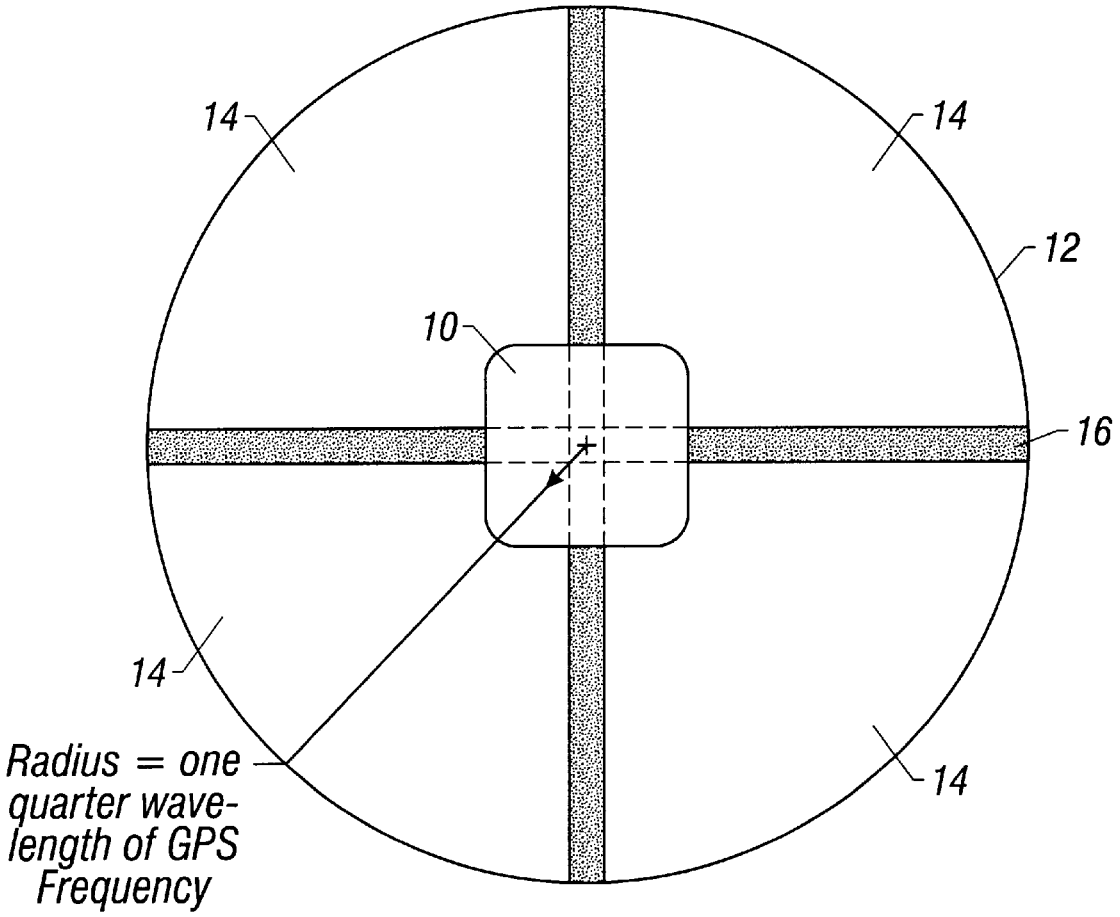
FIG. 1 is a top view of an antenna structure according to one embodiment of the present invention.

FIG. 1 illustrates a top schematic view of an illustrative embodiment of the present invention. Antenna 10 is centered on and in electrical contact with ground plane 12.

Ground plane 12 consists of RAM 14 interspersed with equally spaced radials 16. In this embodiment, a high degree of performance is achieved with ground plane 12 in the shape of a disc. As seen below in FIG. 7, other shapes may be used as a matter of design choice. Many materials have radio absorbing properties and may be used in the present invention as RAM 14. RAM 14 can be made of any material which dissipates electric fields or electromagnetic fields. The specific material that is chosen depends on the demands of a particular application. In an exemplary embodiment, RAM 14 is a carbon loaded paint that is sprayed onto a substrate. In this embodiment, the substrate does not contribute to the function of the ground plane other than being a surface for the RAM to adhere to.

Radials 16 are made of a conductive material and are in electrical contact with RAM 14. The particular materials that radials 16 are composed of do not affect the performance of the ground plane significantly, so long as the radials are electrically conductive. In order to achieve desired performance levels, radials 16 must be in electrical contact with RAM 14. Weaving radials 16 through RAM 14 is one such way of maintaining the electrical contact. An example of a material that radials 16 may be made from is solder wick. Solder wick is pliable as well as electrically conductive. Its pliability allows it to be more easily woven through RAM 14. Other methods of maintaining electrical contact (see FIG. 2) may be used as a matter of design choice. For example, in alternative embodiments of the present invention, both RAM 14 and radials 16 may be physically connected to antenna 10 rather than to each other so long as the electrical effect of the radials is extended through the RAM simulating a "solid" conductive disk.

In this embodiment optimal levels of performance were achieved with radials 16 sized such that their effective lengths were at least one quarter of the wavelength of the desired (i.e., the GPS) frequency. With the desired L1 GPS frequency of 1.575 GHZ, this equates to approximately 9 cm. When the diameters were shorter than 9 cm, the front to back signal isolation quickly fell, significantly degrading performance.

Specifically, in this embodiment, ground plane 12 is made from a 10 cm diameter disk of RAM 14 with four radials 16 spaced evenly throughout. Using radials with diameters larger than a quarter of the desired wavelength does not result in a significant corresponding increase in the performance of the ground plane. The length must be increased significantly before it has a substantive impact on the performance of the ground plane.

Increasing the number of radials has a more immediate impact. Though, the number of radials used is generally proportional to performance of the ground plane, the corresponding increase in performance is non-linear. For example, in this embodiment, significant increases in performance occurred with the use of up to four radials. However, a subsequent substantive performance increase does not occur until 32 or more radials are used. In this embodiment, four radials was chosen to balance performance with mechanical complexity. Fewer radials correspond to easier manufacturing and a high degree of mechanical flexibility in the ground plane itself.

Finally, higher levels of performance was achieved with radials 16 evenly spaced throughout the RAM 14. Evenly spaced radials 16 simulate a continuous ground plane better than if they are not evenly spaced. This characteristic is more pronounced with a lower number of radials 16. In certain configurations in which radials 16 were not evenly spaced, the front to back signal ratio is reduced.

In alternative embodiments, antenna 10 may not necessarily be centered on ground plane 12. In these instances, some of the radials 16 will be shortened while others will be lengthened. The shortened radials will not function as well, particularly if the shortened radials are shorter than ¼ of the wavelength of the desired frequency. The lengthened radials will not add much, if any, improvement.

Figure 2:
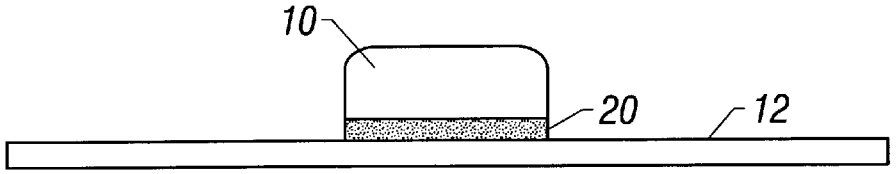
FIG. 2 is a side sectional view of the antenna structure embodiment of FIG. 1.

FIG. 2 illustrates a side sectional view of an illustrative embodiment of the present invention. Conductor 20 is coupled between antenna 10 and ground plane 12 in order to maintain electrical contact between the two elements. One material suitable for this use is conduction epoxy. Any conduction epoxy can be used provided it is compatible with the materials in the antenna, ground plane, and the surface to which it will be mounted. Other materials may be selected for this application as a matter of design choice. For example, mechanically clamping or soldering antenna 10 and ground plane 12 would work as well.

Figure 3:
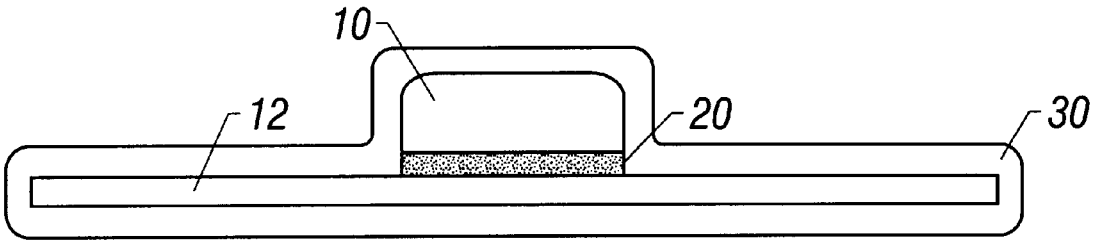
FIG. 3 is a side sectional view of an antenna structure encased in a nonconductive layer according to one embodiment of the present invention.

FIG. 3 illustrates an alternative embodiment of the present invention, wherein antenna 10 and ground plane 12 are enclosed within casing 30. Casing 30 may be any non-conductive material such as plastic. Enclosing antenna 10 and ground plane 12 in a non-conductive material allows the invention to functional in adverse environmental conditions without its performance being degraded. Depending on the demands of a particular application, other alternative embodiments of the present invention include encasing only antenna 10 or ground plane 12 within a non-conductive casing.

Figure 4:
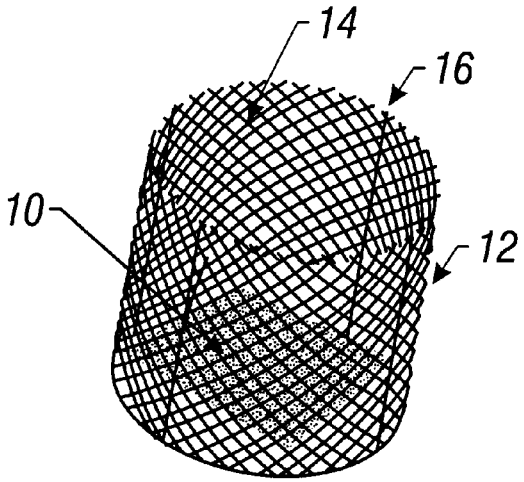
FIG. 4 is a perspective view of an antenna structure in its folded configuration according to one embodiment of the present invention.

FIG. 4 illustrates one embodiment of the present invention in which the ground plane is adapted to be folded. Sometimes it is desirable for ground plane 12 to be compressible and flexible. For example, an application may require that the antenna structure can be placed into or stored within a container (see FIG. 6).

In this embodiment, it is necessary that the ground plane can be folded. RAM 14 is inherently flexible and is easily manipulated. Radials 16 are made of a high modulus material and are sized not to be overstressed when they are bent. Ground plane 12 can thus be folded, reducing the size of the antenna structure even further. Two benefits contemplated for use in GPS applications are ease of packing and storage. When released, high modulus radials 16 act like torsion springs and return ground plane 12 to substantially its original "flat" configuration (see, e.g., FIGS. 1 and 2).

Figure 5:
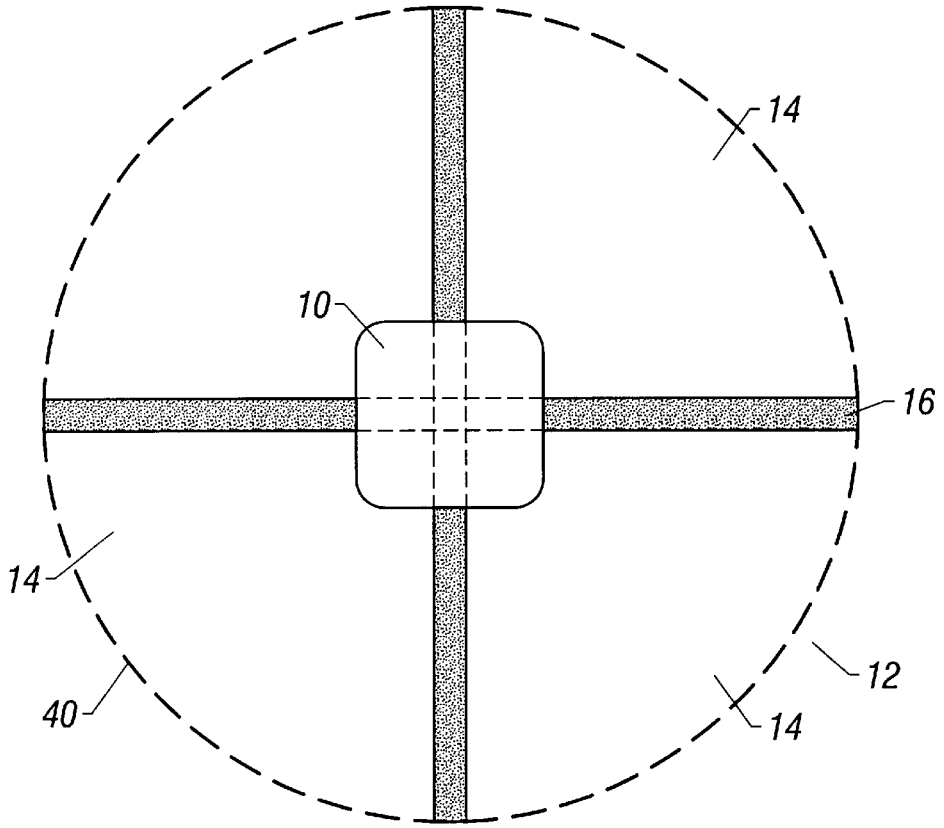
FIG. 5 is a top view of the antenna structure in FIG. 4 further comprising a spring according to one embodiment of the present invention.

FIG. 5 illustrates an antenna structure as illustrated in FIG. 4 further comprising a spring according to one embodiment of the present invention. Spring 40 is attached to the circumference of ground plane 12. The method of attachment is a design decision and may be accomplished, for example, by sewing spring 40 to RAM 14 along the peripheral of ground plane 12. Spring 40 assists high modulus radials 16 in returning the antenna structure to substantially its original configuration after, for example, the structure is folded as shown in FIG. 4.

Spring 40, when attached to the circumference of ground plane 12, can be used to return the antenna structure to substantially its original configuration even when radials 16 are made of low modulus material such as stranded wire or solder wick. An advantage of using low modulus material is that ground plane 16 could be folded into a smaller package than if radials 16 were made from high modulus material.

Figure 6:
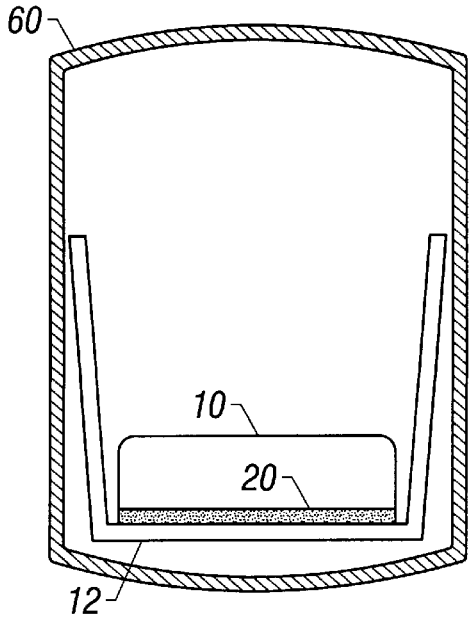
FIG. 6 is a side view of the folded antenna structure embodiment of FIG. 4 inside of a container according to one embodiment of the present invention.

FIG. 6 illustrates a side view of the folded antenna structure of FIG. 4 inside of container 20 according to one embodiment of the present invention. In this embodiment, the antenna structure may easily be transported or stored within container 20. It is thus necessary to have an antenna structure that may be placed in a packaged configuration without permanently deforming the radials. As discussed above, when released from container 20, radials 16 return ground plane 12 to substantially its original "flat" configuration (see, e.g., FIGS. 1 and 2).

Figure 7:
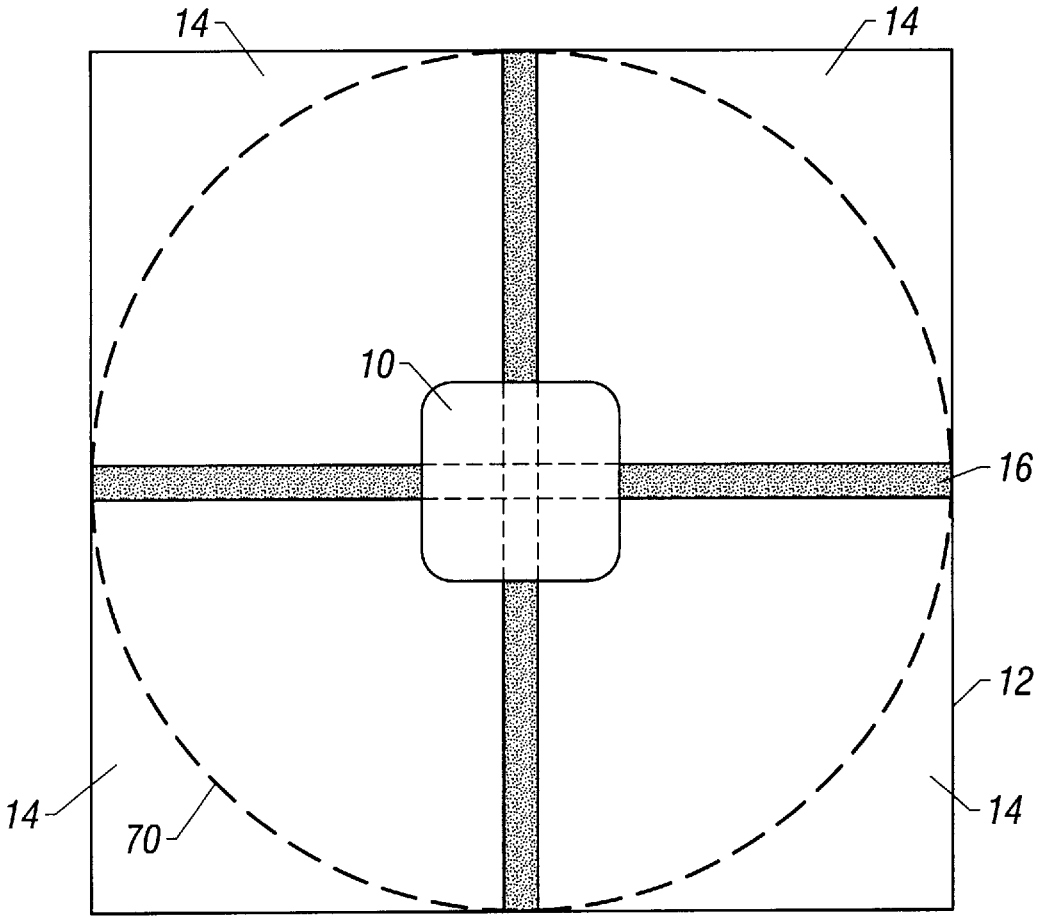
FIG. 7 is a top schematic view of an antenna structure wherein the ground plane is square according to one embodiment of the present invention.

FIG. 7 illustrates a top schematic view of an embodiment of the present invention with a square ground plane 12.

The effective length of each radial is the distance between the edge of the ground plane and the center from which the radial originated. So long as there is at least one quarter of a wavelength between the edge of the ground point and the center of it at all points, the ground plane should function well. Thus, this embodiment, which features a square-shaped ground plane, would function at desired levels of performance as long as the sides are ½ the wavelength of the GPS frequency.

For practical purposes, square ground plane 12 would perform substantially the same as a round ground plane 70 with radials the length of radius 72. As mentioned above, the area of ground plane 12 must be increased significantly beyond that of a circle with a radius equal to ¼ the wavelength of the desired frequency to have a practical effect on the performance of the invention. Therefore, given the relatively small size of areas 14 of square ground plane 12, areas 14 do not contribute substantively to the performance of the ground plane.

Other shapes may be used for ground plane 12 as a matter of design decisions. These other-shaped ground planes will yield desired levels of performance if all of the radials are at least ¼ the wavelength of the desired frequency.

What is claimed is:

1. An antenna structure comprising:

an antenna adapted to receive broadcast signals; and a ground plane electrically connected to the antenna, the ground plane comprising radar absorbing material and at least one radial in electrical contact with the radar absorbing material.

2. The antenna structure in claim 1, wherein the antenna is substantially centered on the ground plane.

3. The antenna structure in claim 1, wherein the effective length of the at least one radial is substantially one-fourth of the wavelength of a desired broadcast signal.

4. The antenna structure in claim 1, further comprising a plurality of radials in electrical contact with the ground plane.

5. The antenna structure in claim 4, wherein the plurality of radials comprises at least four radials.

6. The antenna structure in claim 4, wherein the radials are spaced evenly through the radar absorbing material.

7. The antenna structure in claim 1, wherein the at least one radial is woven through the radio absorbing material.

8. The antenna structure in claim 1, wherein the radar absorbing material comprises a conductive material adhered to a non-conductive surface.

9. The antenna structure in claim 1, wherein the antenna comprises a patch antenna.

10. The antenna structure in claim 1, wherein the broadcast signals are Global Positioning System (GPS) signals.

11. The antenna structure in claim 1, wherein the ground plane is substantially circular.

12. The antenna structure in claim 1, wherein the at least one radial comprises high modulus material;

wherein the ground plane is adapted to be folded, and then assumes substantially a flat configuration during use.

13. The antenna structure in claim 12, wherein the ground plane further comprises a spring that will aid in returning the ground plane to substantially its original configuration when released during use.

14. The antenna structure in claim 1, wherein the ground plane is adapted to be folded, and then assumes substantially a flat configuration during use; and wherein the ground plane further comprises a spring that will aid in returning the ground to substantially its original configuration when released during use.

15. The antenna structure in claim 1, further comprising a nonconductive layer that encases the ground plane.

16. The antenna structure in claim 1, further comprising a nonconductive layer that encases the antenna.

17. The antenna structure in claim 1, further comprising a nonconductive layer that encases the ground plane and the antenna.

18. A method of using an antenna structure comprising:

obtaining an antenna structure comprising:

an antenna; and a ground plane electrically connected to the antenna, comprising radar absorbing material and at least one radial in electrical contact with the radar absorbing material employing the antenna structure to receive broadcast signals, whereby the ground plane is adapted to improve front to back isolation of the antenna structure.

19. The method of claim 18, wherein the broadcast signals are Global Positioning System signals.

20. The method of claim 18, wherein the ground plane improves on the front to back isolation of the antenna structure by suppressing surface currents on the ground plane during use.

21. The method of claim 18, wherein the front to back signal isolation is at least 10 dBs when measured over salt water.

22. The method of claim 18, wherein the effective length of the at least one radial is one-fourth of the wavelength of a desired broadcast signal.

23. The method of claim 18, wherein the antenna structure further comprises a plurality of radials in electrical contact with the radar absorbing material.

24. The method of claim 23, wherein the plurality of radials comprises at least four radials.

25. The method of claim 23, wherein the radials are spaced evenly through the radar absorbing material.

26. The method of claim 18, wherein the radial is woven through the radio absorbing material.

27. The method of claim 18, wherein the ground plane is substantially circular.

28. A method of using an antenna structure comprising:

obtaining a flexible antenna structure comprising:

a patch antenna;

a ground plane electrically connected to the patch antenna, comprising radar absorbing material, a plurality radials in electrical contact with the radar absorbing material, a spring to aid in placing the ground plane in substantially a flat configuration when released during use, wherein the ground plane is adapted to be folded; and employing the antenna structure to receive GPS signals, whereby the ground plane is adapted to improve front to back isolation of the flexible antenna structure.

29. The method of claim 28, wherein the radials comprise high modulus material.

* * * * *

UNITED STATES PATENT AND TRADEMARK OFFICE

CERTIFICATE OF CORRECTION

PATENT NO. : 6,100,855

DATED : August 8, 2000

INVENTOR(S) : James K. Vinson; Armando DeJesus

It is certified that error appears in the above-identified patent and that said Letters Patent is hereby corrected as shown below:

In claim 7, column 7, line 42, delete "radio" and insert therefor --radar--.
In claim 26, column 8, line 41, delete "radio" and insert therefor --radar--.
In claim 28, column 8, line 49, after "plurality" insert --of--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*